US008267704B2

(12) United States Patent
Cheng et al.

(10) Patent No.: US 8,267,704 B2
(45) Date of Patent: Sep. 18, 2012

(54) CONNECTOR MODULE CAPABLE OF PROTECTING CONDUCTIVE RESILIENT COMPONENTS THEREOF

(75) Inventors: Shian-Luen Cheng, Kaohsiung (TW); Li-Min Lien, Hsinchu County (TW); Wen-Jeng Fang, Taipei (TW)

(73) Assignee: Transcend Information, Inc., NeiHu Dist, Taipei (TW)

( * ) Notice: Subject to any disclaimer, the term of this patent is extended or adjusted under 35 U.S.C. 154(b) by 108 days.

(21) Appl. No.: 13/018,437

(22) Filed: Feb. 1, 2011

(65) Prior Publication Data

US 2012/0196460 A1 Aug. 2, 2012

(51) Int. Cl.
*H01R 13/44* (2006.01)

(52) U.S. Cl. ..... 439/131; 439/630

(58) Field of Classification Search ..... 439/131, 439/172, 374, 660, 630
See application file for complete search history.

(56) References Cited

U.S. PATENT DOCUMENTS

| | | | | |
|---|---|---|---|---|
| 8,157,574 | B2 * | 4/2012 | Hsiao | 439/131 |
| 8,206,163 | B2 * | 6/2012 | Zhao et al. | 439/131 |
| 2011/0130018 | A1 * | 6/2011 | Gao et al. | 439/131 |
| 2011/0217858 | A1 * | 9/2011 | Zhao et al. | 439/131 |
| 2012/0015534 | A1 * | 1/2012 | Wavra et al. | 439/131 |

* cited by examiner

*Primary Examiner* — Khiem Nguyen
(74) *Attorney, Agent, or Firm* — Winston Hsu; Scott Margo

(57) ABSTRACT

A connector module is disclosed in the present invention. The connector module includes a housing defining an interior chamber, and a substrate installed inside the interior chamber of the housing. A first set of metal contacts and a second set of metal contacts are disposed on the substrate. The connector module further includes a sliding component slidably relative to a side of the substrate, and at least one conductive resilient component installed on the sliding component. The conductive resilient component is hidden inside the housing when the sliding component slides into the interior chamber of the housing, and the conductive resilient component is exposed outside the housing to electrically contact the second set of metal contacts when the sliding component slides out of the interior chamber of the housing.

16 Claims, 6 Drawing Sheets

CONNECTOR MODULE CAPABLE OF PROTECTING CONDUCTIVE RESILIENT COMPONENTS THEREOF

BACKGROUND OF THE INVENTION

1. Field of the Invention

The present invention is related to a connector module, and more particularly, to a USB connector module capable of protecting conductive resilient components thereof by means of sliding mechanism.

2. Description of the Prior Art

With the advanced technology, a USB 3.0 connector is designed for increasing speed of data transmission that is obviously faster than a USB 2.0 connector. One type of conventional USB 3.0 connector includes a substrate, a first set of metal contacts, a second set of metal contacts and a plurality of resilient metal pieces. The first set of metal contacts conforms to USB 2.0 standard and is disposed on a front end of the substrate. The first set of metal contacts and the second set of metal contacts collectively conform to USB 3.0 standard, and the second set of metal contacts and the corresponding resilient metal pieces are disposed on a middle end of the substrate. The plurality of resilient metal pieces is disposed on the substrate for electrical connection.

Thus, the plurality of resilient metal pieces is damaged easily due to fatigue and physical collision of an external object as being exposed outside, and it might be damaged due to electrical conduction with other charged component. Therefore, design of a connector module with preferable protection, such as preventing from electrical conduction with other charged component, and protecting the metal contacts and the resilient metal pieces from being damaged by physical collision of the external object, is an important issue in the memory connector industry.

SUMMARY OF THE INVENTION

The present invention provides a connector module capable of protecting conductive resilient components thereof by means of sliding mechanism for solving above drawbacks.

According to one aspect of the invention, a connector module includes a housing defining an interior chamber, and a substrate installed inside the interior chamber of the housing. A first set of metal contacts and a second set of metal contacts are disposed on the substrate. The connector module further includes a sliding component slidably relative to a side of the substrate, and at least one conductive resilient component installed on the sliding component. The conductive resilient component is hidden inside the housing when the sliding component slides into the interior chamber of the housing, and the conductive resilient component is exposed outside the housing to electrically contact the second set of metal contacts when the sliding component slides out of the interior chamber of the housing.

According to another aspect of the invention, the sliding component is slidably connected to the housing.

According to another aspect of the invention, the sliding component is slidably connected to the substrate.

According to another aspect of the invention, the conductive resilient component is resiliently deformed to electrically contact the second set of metal contacts as being pressed by a second set of terminals of a receptacle so as to conduct the second set of metal contacts with the second set of terminals when the connector module is inserted into the receptacle with the sliding component sliding out of the interior chamber of the housing.

According to another aspect of the invention, when the connector module is inserted into the receptacle with the sliding component retracting into the interior chamber of the housing, the connector module can transfer data with the receptacle according to a first standard, and when the connector module is inserted into the receptacle with the sliding component sliding out of the interior chamber of the housing, the connector module can transfer data with the receptacle according to a second standard.

According to another aspect of the invention, the first standard is a Universal Serial Bus (USB) 3.0 standard, and the second standard is a USB 2.0 standard.

According to another aspect of the invention, a slot is formed on the housing, and the sliding component includes a base for supporting the conductive resilient component, and a slide button connected to the base through the slot. The slide button moves in a first direction for extending the base from the interior chamber of the housing, and the slide button moves in a second direction opposite to the first direction for retracting the base within the interior chamber of the housing.

According to another aspect of the invention, the connector module further comprises a first detent for standing the sliding component at a fully extended position relative to the housing, and a second detent for standing the sliding component at a fully retracted position relative to the housing.

According to another aspect of the invention, wherein the conductive resilient component is resiliently deformed to electrically contact the second set of metal contacts as being pressed by a second set of terminals of a receptacle so as to conduct the second set of metal contacts with the second set of terminals when the connector module is inserted into the receptacle with the sliding component at the fully extended position relative to the housing.

According to another aspect of the invention, wherein the housing comprises a bottom plate disposed on a side of the substrate opposite to the first set of metal contacts and the second set of metal contacts, and a top plate disposed on another side of the substrate facing to the first set of metal contacts and the second set of metal contacts, wherein a length of the bottom plate is greater than a length of the top plate.

According to another aspect of the invention, wherein the first set of metal contacts electrically contacts with a first set of terminals of the receptacle to enable the connector module to transfer data with the receptacle according to a first standard when the connector module is inserted into the receptacle with the top plate contacting against the receptacle and the second detent stopping the sliding component at the fully retracted position relative to the housing.

According to another aspect of the invention, wherein the first set of metal contacts electrically contacts with a first set of terminals of the receptacle and the resilient conductive component conducts the second set of metal contacts with the second set of terminals of the receptacle to enable the connector module to transfer data with the receptacle according to a second standard when the connector module is inserted into the receptacle with the top plate contacting against the receptacle and the first detent stopping the sliding component at the fully extended position relative to the housing.

According to another aspect of the invention, the connector module further includes a spring connected to the sliding component for automatically restoring the sliding component to an initial position as the sliding component disengages from the first detent or the second detent.

According to another aspect of the invention, the conductive resilient component comprises a V-shaped section and a reverse V-shaped section electrically connected to each other, and the V-shaped section of the conductive resilient component is for contacting the second set of metal contacts, and the reverse V-shaped section of the conductive resilient component is for being pressed by the receptacle.

The connector module of the present invention can move the sliding component supporting the conductive resilient components relative to the housing to stand at the fully extended position for inserting into and electrically contacting the receptacle, and can further move the sliding component relative to the housing to stand at the fully retracted position for protection of the conductive resilient components from being damaged due to fatigue and collision of an external object and for protection of the connector module from electrical conduction with other charged component through the resilient component. Besides, the conductive resilient component does not electrically contact the second set of metal contacts when the sliding component stands at the fully retracted position, so as to prevent the connector module from damage of electrical conduction and physical collision.

These and other objectives of the present invention will no doubt become obvious to those of ordinary skill in the art after reading the following detailed description of the preferred embodiment that is illustrated in the various figures and drawings.

DETAILED DESCRIPTION

Figure 1:
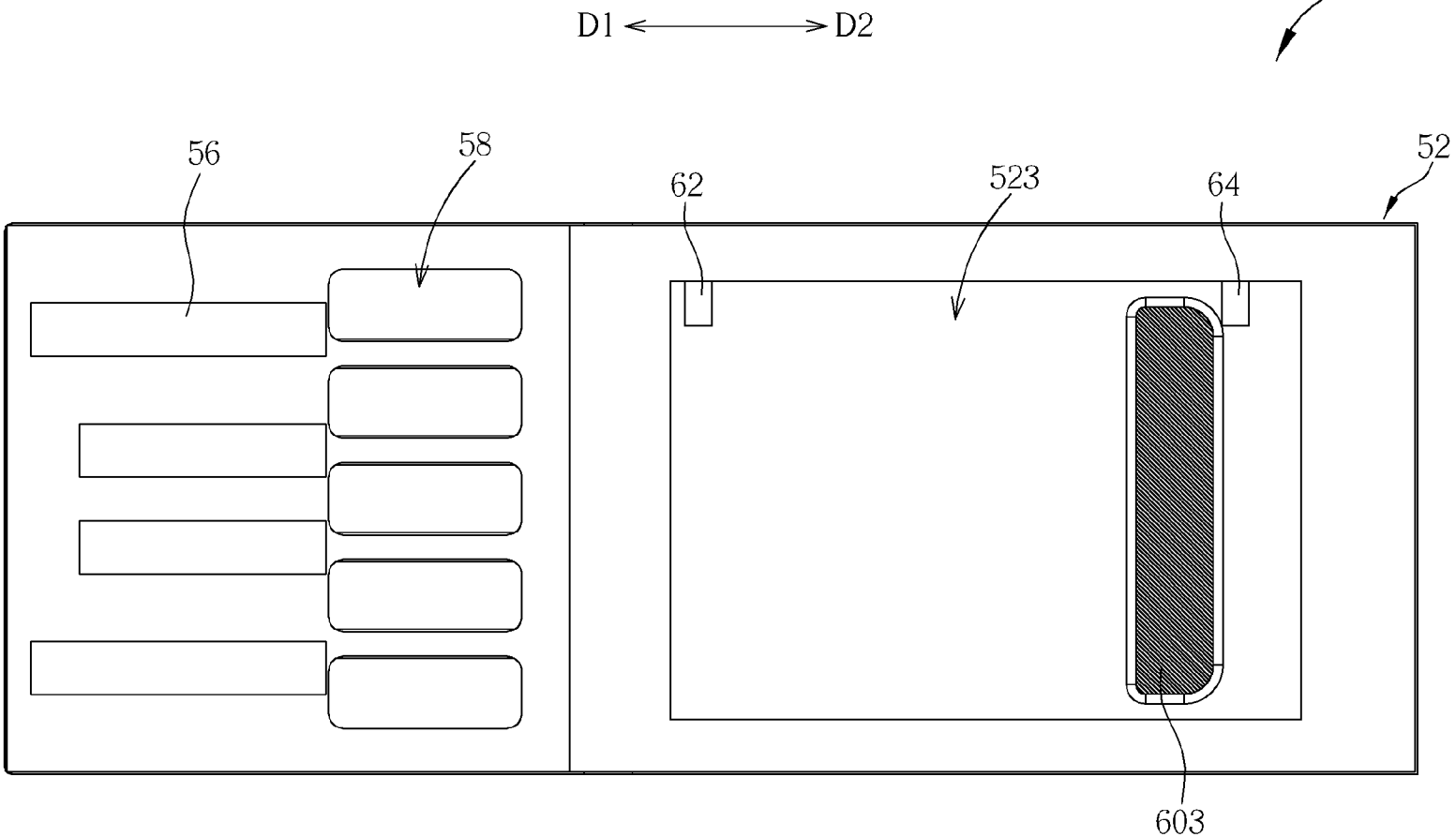
FIG. 1 and FIG. 2 are drawings of a connector module indifferent statuses according to a preferred embodiment of the present invention.
Figure 2:
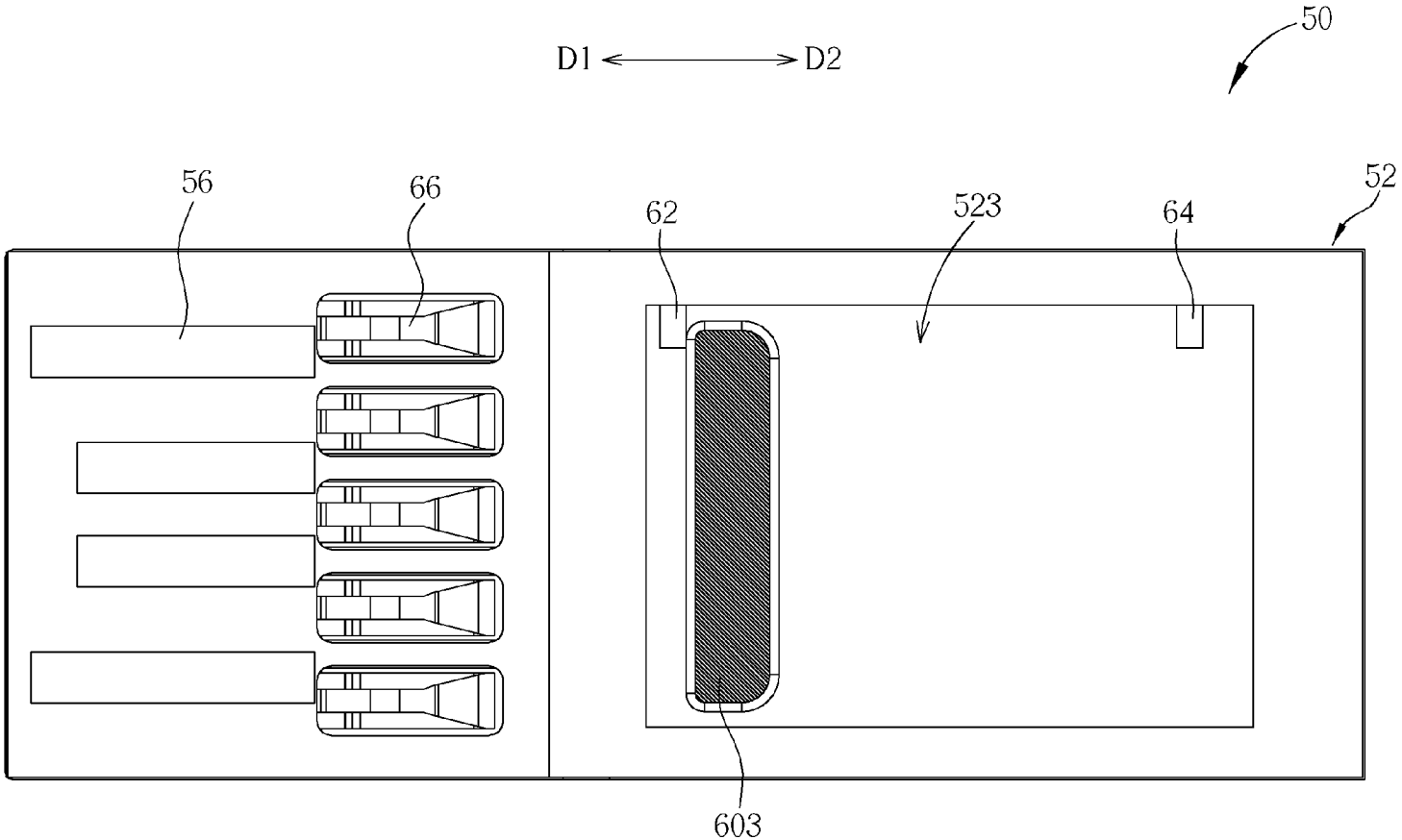
Figure 3:
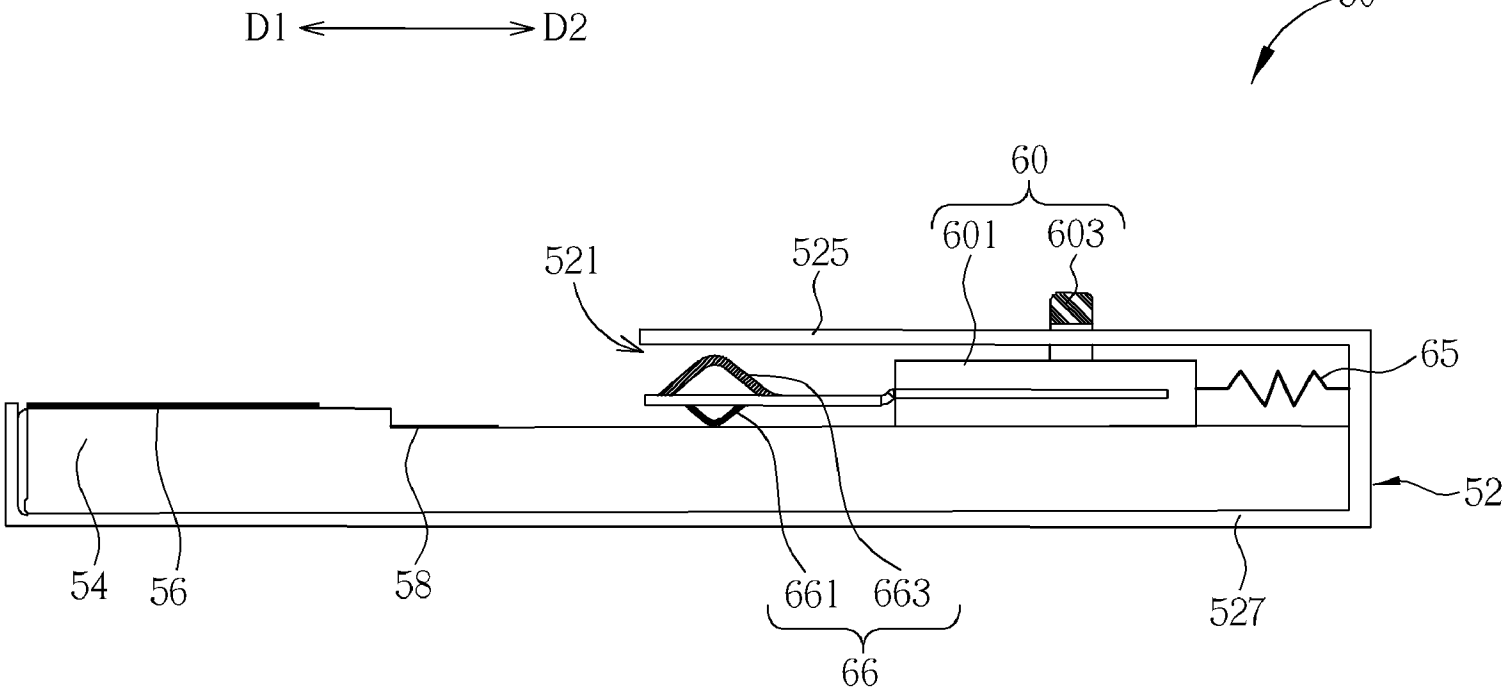
FIG. 3 and FIG. 4 are internal lateral diagrams showing schematic configuration of the connector module indifferent statuses according to the preferred embodiment of the present invention.
Figure 4:
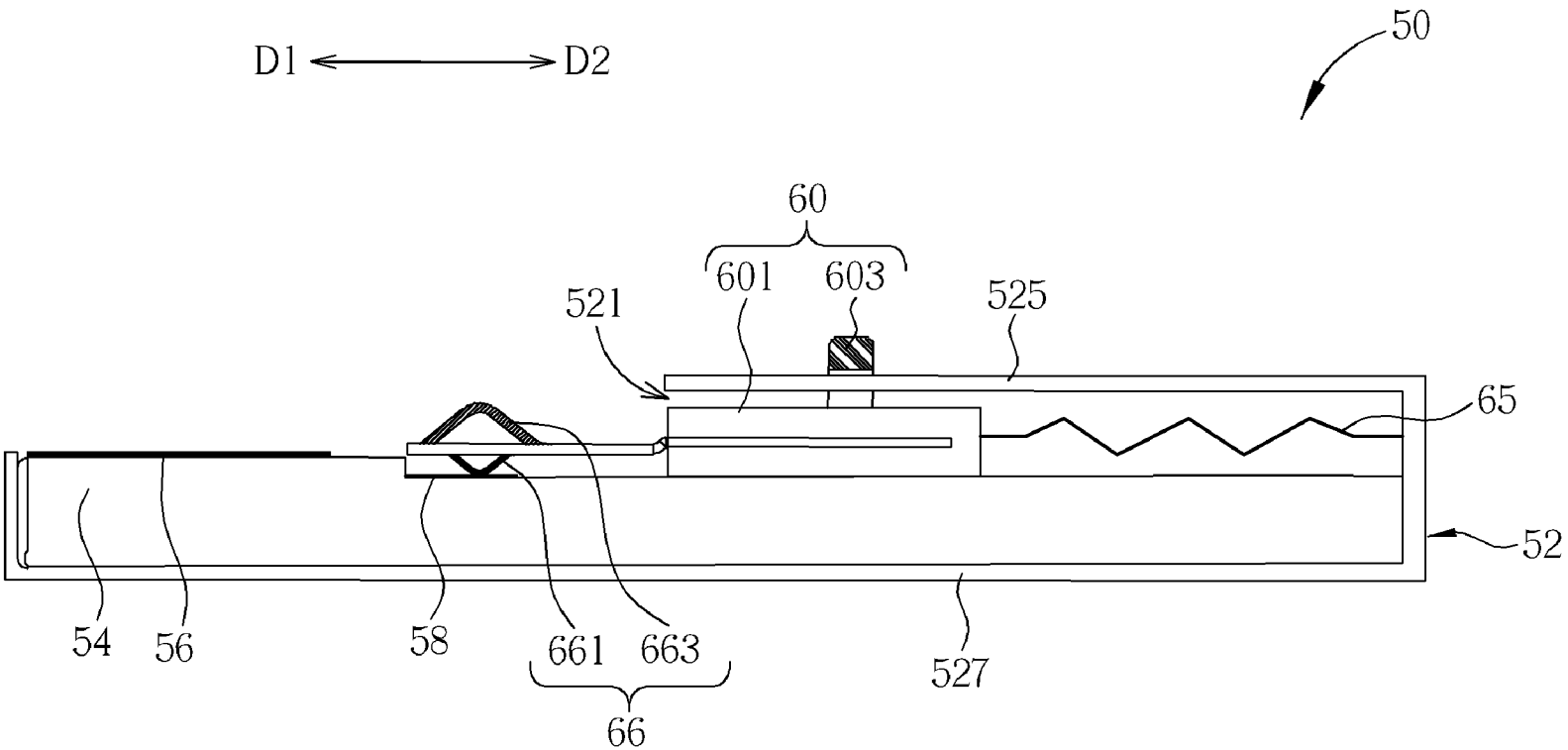

Please refer to FIG. 1 to FIG. 4. FIG. 1 and FIG. 2 are drawings of a connector module 50 in different statuses according to a preferred embodiment of the present invention. FIG. 3 and FIG. 4 are internal lateral diagrams showing schematic configuration of the connector module 50 in different statuses according to the preferred embodiment of the present invention. The connector module 50 can be a USB 3.0 connector module which is also compatible with a USB 2.0 connector receptacle. The connector module 50 includes a housing 52 defining an interior chamber 521 thereinside. A slot 523 is formed on the housing 52. The housing 52 includes a top plate 525 and a bottom plate 527. A length of the bottom plate 527 is greater than a length of the top plate 525. The connector module 50 further includes a substrate 54 installed inside the interior chamber 521 of the housing 52, and a first set of metal contacts 56 and a second set of metal contacts 58 are disposed on the substrate 54. The bottom plate 527 is disposed on a side of the substrate 54, and the top plate 525 is disposed on another side of the substrate 54. That is, the bottom plate 527 is disposed on the side of the substrate opposite to the first set of metal contacts 56 and the second set of metal contacts 58, and the top plate is disposed on another side of the substrate facing to the first set of metal contacts 56 and the second set of metal contacts 58.

The connector module 50 further includes a sliding component 60 slidably relative to a side of the substrate 54. In this embodiment, the sliding component 60 is slidably connected to the housing 52. The sliding component 60 also can be slidably connected to the substrate 54 according to another embodiment. For example, the sliding component 60 can be slidably connected to the housing 52 or the substrate 54 with a track mechanism of grooves and protrusions, and so on. The sliding component 60 includes a base 601, and a slide button 603 connected to the base 601 through the slot 523 on the housing 52. The slide button 603 can be moved in a first direction D1 for extending the base 601 from the interior chamber 521 of the housing 52, as from the status shown in FIG. 1 and FIG. 3 to the status shown in FIG. 2 and FIG. 4. The slide button 603 also can be moved in a second direction D2 opposite to the first direction D1 for retracting the base 601 within the interior chamber 521 of the housing 52, as from the status shown in FIG. 2 and FIG. 4 to the status shown in FIG. 1 and FIG. 3. In an embodiment, the slide button 603 slides against an end of the slot 523 on the housing 52 to stand the sliding component 60 at a fully extended position relative to the housing 52, and the slide button 603 slides against the other end of the slot 523 on the housing 52 to stand the sliding component 60 at a fully retracted position relative to the housing 52. Furthermore, the connector module 50 can further include a first detent 62 to stand the sliding component 60 at a fully extended position relative to the housing 54 and a second detent 64 to stand the sliding component 60 at a fully retracted position relative to the housing 54. The first detent 62 and the second detent 64 which can be disposed on two ends of the slot 523 or on other places. Therefore, the sliding component 60 can be moved relative to the housing 52 via the slide button 603, so as to switch the sliding component 60 between the fully extended position and the fully retracted position. It should be mentioned that the first detent 62 and the second detent 64 can respectively be protrusions or concaves. Structures of the detents are not limited to the above-mentioned embodiment and depend on actual demand. In additional, the connector module 50 can further include a spring 65 connected to the sliding component 60 for automatically restoring the sliding component 60 to an initial position as the sliding component 60 disengages from the first detent 62 or the second detent 64.

The connector module 50 further includes at least one conductive resilient component 66 installed on the base 601 of the sliding component 60. In one embodiment of present invention, the first set of metal contacts 56 can conform to USB 2.0 standard, and the first set of metal contacts 56 and the second set of metal contacts 58 can collectively conform to USB 3.0 standard. In this embodiment, the first set of metal contacts 56 includes four metal contacts, and the second set of metal contacts 58 includes five metal contacts. Thus, an amount of the conductive resilient components 66 corresponds to an amount of the second set of metal contacts 58, which means the connector module 50 of the present invention includes five conductive resilient components 66, and positions of the conductive resilient components 66 are set according to arrangement of the second set of metal contacts 58. The conductive resilient components 66 are hidden inside the housing 52 when the sliding component 60 slides into the interior chamber 521 of the housing 52, and the conductive resilient components 66 are exposed outside the housing 52 to electrically contact the second set of metal contacts 58 when the sliding component 60 slides out of the interior chamber 521 of the housing 52.

Figure 5:
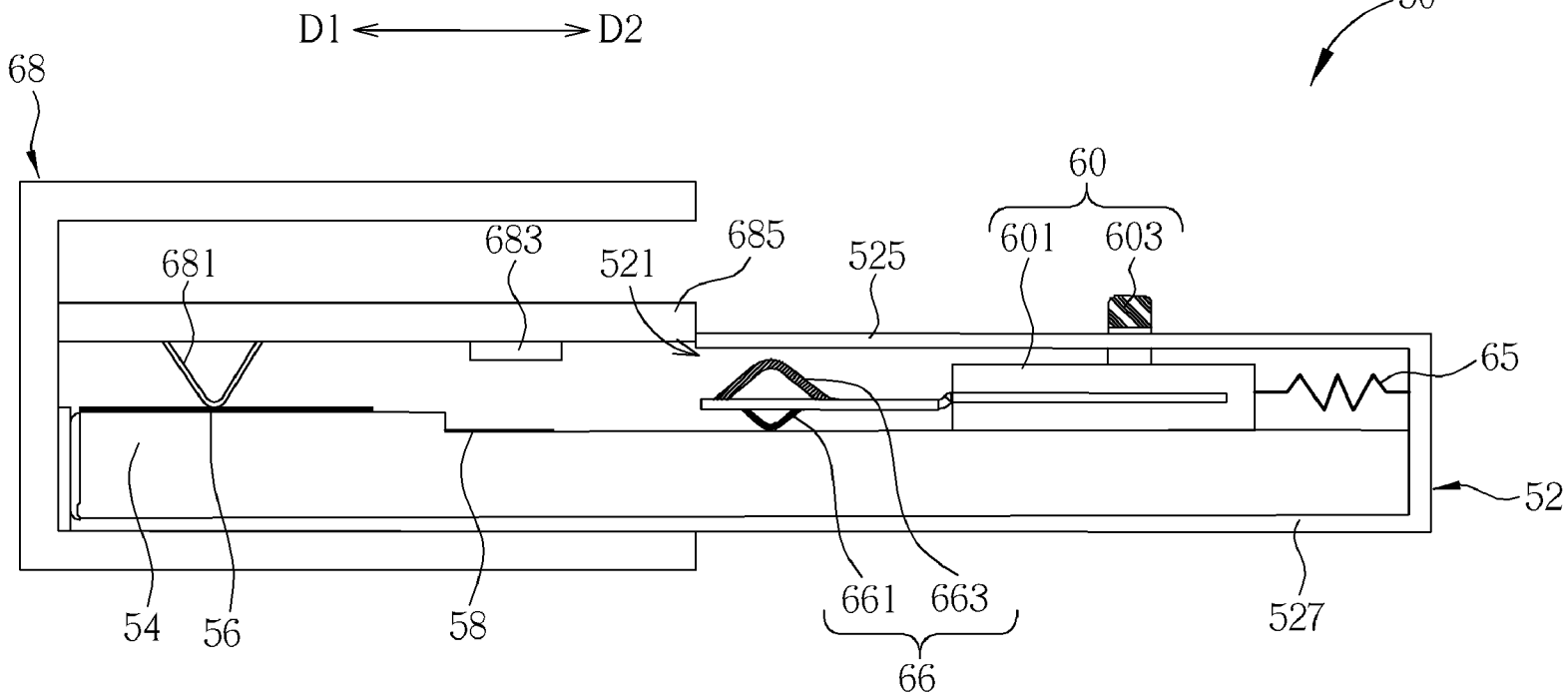
FIG. 5 and FIG. 6 are internal lateral diagrams of the connector module inserted into a receptacle in different statuses according to the preferred embodiment of the present invention.
Figure 6:
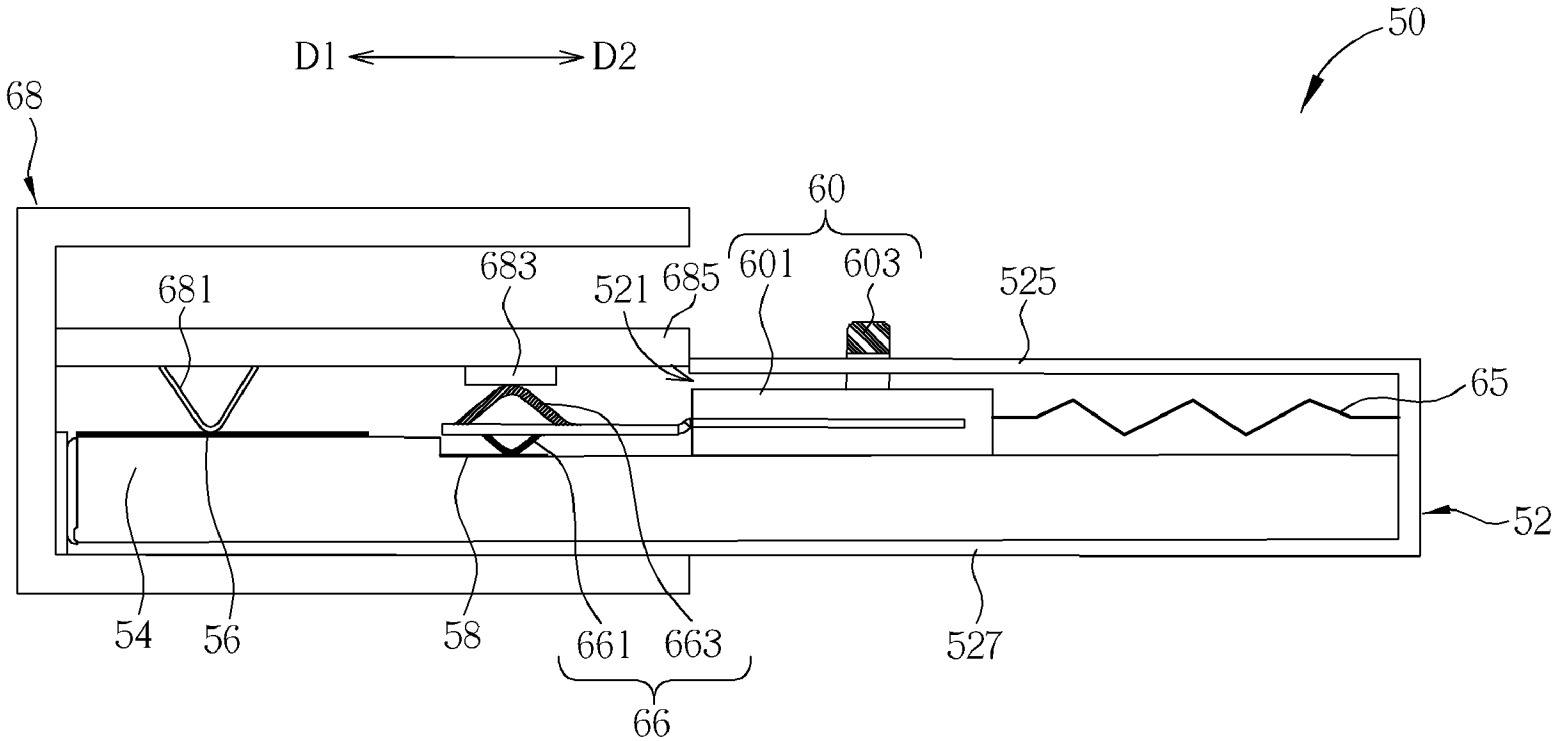

Please refer to FIG. 5 and FIG. 6. FIG. 5 and FIG. 6 are internal lateral diagrams of the connector module 50 inserted into a USB 3.0 receptacle 68 in different statuses according to the preferred embodiment of the present invention. The connector module 50 can be inserted into the receptacle 68 for electrical connection and data transmission. In another embodiment of present invention, the receptacle 68 can be a USB 2.0 receptacle. The receptacle 68 includes a first set of terminals 681 and a second set of terminals 683. The first set of terminals 681 can conform to USB 2.0 standard, and the first set of terminals 681 and the second set of terminals 683 can collectively conform to USB 3.0 standard. In this embodiment, the first set of terminals 681 includes four metal terminals, and the second set of terminals 683 includes five metal terminals. As shown in FIG. 5 and FIG. 6, when the connector module 50 is inserted into the receptacle 68 so that the bottom plate 527 of the housing 52 is inserted inside the receptacle 68 and the top plate 525 of the housing 52 contacts against a tongue 685 of the receptacle 68, with whether the sliding component 60 sliding out of the interior chamber 521 of the housing 52 or retracting into the interior chamber 521 of the housing 52, the first set of metal contacts 58 of the connector module 50 electrically contacts the first set of terminals 681 of the receptacle 68. That is, an abutment of the top plate 525 and the tongue 685 of the receptacle 68 can locate the first set of metal contacts 58 at a predetermined position relative to the receptacle 68 for electrically contacting the first set of terminals 681 precisely. Alternately, it can be designed that when the top plate 525 of the housing 52 contacts against a casing of the receptacle 68 or a covering whereon the receptacle 68 is disposed, the first set of metal contacts 58 of the connector module 50 electrically contacts the first set of terminals 681 of the receptacle 68. When the connector module 50 is inserted into the receptacle 68 with the sliding component 60 retracting into of the interior chamber 521 of the housing 52, the connector module 50 can transfer data with the receptacle 68 according to a first standard. For example, the first standard can be a USB 2.0 standard.

As shown in FIG. 6, after the slide button 603 is pushed to move in the first direction D1 for extending the base 601 from the interior chamber 521 of the housing 52 to stand the sliding component 60 at the fully extended position relative to the housing 52, the connector module 50 can be inserted into the receptacle 68 so that the bottom plate 527 of the housing 52 is inserted inside the receptacle 68 and the top plate 525 of the housing 52 contacts against the tongue 685 of the receptacle 68. It can be designed that the slide button 603 slides against an end of the slot 523 to stand the sliding component 60 at the fully extended position relative to the housing 52, or the first detent 62 stops the sliding component 60 to stand at the fully extended position. Meanwhile, when the connector module 50 is inserted into the receptacle 58 with the sliding component 60 standing at the fully extended position relative to the housing 52, besides that the first set of metal contacts 58 of the connector module 50 electrically contacts with the first set of terminals 681 of the receptacle 68, the conductive resilient component 66 is exposed outside the housing 52 and resiliently deformed to electrically contact the second set of metal contacts 58 as being pressed by the second set of terminals 683 of the receptacle 68, so as to conduct the second set of metal contacts 58 with the second set of terminals 683. At this time, the connector module 50 can transfer data with the receptacle 58 according to a second standard. For example, the second standard can be a USB 3.0 standard. On the other hand, as shown in FIG. 5, the second set of metal contacts 58 and the second set of terminals 683 do not electrically contact with each other when the sliding component 60 stands at the fully retracted position relative to the housing 52.

Furthermore, each conductive resilient component 66 can include a V-shaped section 661 and a reverse V-shaped section 663, and the V-shaped section 661 is electrically connected to the reverse V-shaped section 663. The V-shaped section 661 of the conductive resilient component 66 is for contacting the second set of metal contacts 58, and the reverse V-shaped section 663 of the conductive resilient component 66 is for being pressed by the second set of terminals 683 of the receptacle 68. When the reverse V-shaped section 663 of the conductive resilient component 66 is pressed by the second set of terminals 683 of the receptacle 68, the conductive resilient component 66 is resiliently deformed and the V-shaped section 661 of the conductive resilient component 66 is able to contact the second set of metal contacts 58 for electrical connection. However, the shape of the conductive resilient component 66 is not limited to the above-mentioned embodiment depending on the design requirement or preference, for example, the conductive resilient component 66 can be composed of two curved sections or a combination of a U-shaped section and a reverse U-shaped section.

In conclusion, the conductive resilient component 66 of the connector module 50 of the present invention can be slidably switched to different positions. The user can push the slide button 603 to drive the base 601 supporting the conductive resilient components 66 out of the housing 52, so as to conduct the second set of metal contacts 58 with the second set of terminals 683 through the conductive resilient components 66. The user also can push the slide button 603 to drive the base 601 supporting the conductive resilient components 66 into the housing 52 for protection and storage as the conductive resilient component 66 separates from the second set of metal contacts 58 and the second set of terminals 683. Therefore, the connector module 50 of the present invention has function of preventing the conductive resilient components 66 from being damaged due to fatigue and physical collision of an external object and preventing the connector module 50 from electrical conduction with other charged component through the resilient component 66, because of isolation of the second set of metal contacts 58 and the conductive resilient components 66. After the sliding component 66 is pushed to stand at the fully extended position relative to the housing 52 and the connector module 50 is inserted into the receptacle 68, the first set of the metal contacts 56 electrically contacts the first set of terminals 681 and the conductive resilient components 66 is pressed by the second set of terminals 683 so that the conductive resilient components 66 electrically contacts the second set of metal contacts 58 for conducting the second set of metal contacts 58 with the second set of terminals 683, so as to transmit data between the connector module 50 and the receptacle 68.

Comparing to the prior art, the connector module of the present invention can move the sliding component supporting the conductive resilient components relative to the housing to stand at the fully extended position for inserting into and electrically contacting the receptacle, and can further move the sliding component relative to the housing to stand at the fully retracted position for protection of the conductive resilient components from being damaged due to fatigue and physical collision of an external object and for protection of the connector module from electrical conduction with other charged component through the resilient component.

Those skilled in the art will readily observe that numerous modifications and alterations of the device and method may be made while retaining the teachings of the invention.

What is claimed is:

1. A connector module, comprising:

a housing defining an interior chamber;

a substrate installed inside the interior chamber of the housing, a first set of metal contacts and a second set of metal contacts being disposed on the substrate; and a sliding component slidably relative to a side of the substrate; and at least one conductive resilient component installed on the sliding component, the conductive resilient component being hidden inside the housing when the sliding component slides into the interior chamber of the housing, and the conductive resilient component being exposed outside the housing to electrically contact the second set of metal contacts when the sliding component slides out of the interior chamber of the housing.

2. The connector module of claim 1, wherein the sliding component is slidably connected to the housing.

3. The connector module of claim 1, wherein the sliding component is slidably connected to the substrate.

4. The connector module of claim 1, wherein the conductive resilient component is resiliently deformed to electrically contact the second set of metal contacts as being pressed by a second set of terminals of a receptacle so as to conduct the second set of metal contacts with the second set of terminals when the connector module is inserted into the receptacle with the sliding component sliding out of the interior chamber of the housing.

5. The connector module of claim 4, wherein when the connector module is inserted into the receptacle with the sliding component retracting into the interior chamber of the housing, the connector module can transfer data with the receptacle according to a first standard, and when the connector module is inserted into the receptacle with the sliding component sliding out of the interior chamber of the housing, the connector module can transfer data with the receptacle according to a second standard.

6. The connector module of claim 5, wherein the first standard is a Universal Serial Bus (USB) 2.0 standard, and the second standard is a USB 3.0 standard.

7. The connector module of claim 1, wherein a slot is formed on the housing, and the sliding component comprises:

a base for supporting the conductive resilient component; and a slide button connected to the base through the slot, the slide button moving in a first direction for extending the base from the interior chamber of the housing, and the slide button moving in a second direction opposite to the first direction for retracting the base within the interior chamber of the housing.

8. The connector module of claim 7, further comprising a first detent for standing the sliding component at a fully extended position relative to the housing, and a second detent for standing the sliding component at a fully retracted position relative to the housing.

9. The connector module of claim 8, wherein the conductive resilient component is resiliently deformed to electrically contact the second set of metal contacts as being pressed by a second set of terminals of a receptacle so as to conduct the second set of metal contacts with the second set of terminals when the connector module is inserted into the receptacle with the sliding component at the fully extended position relative to the housing.

10. The connector module of claim 9, wherein the housing comprises a bottom plate disposed on a side of the substrate opposite to the first set of metal contacts and the second set of metal contacts, and a top plate disposed on another side of the substrate facing to the first set of metal contacts and the second set of metal contacts, wherein a length of the bottom plate is greater than a length of the top plate.

11. The connector module of claim 10, wherein the first set of metal contacts electrically contacts with a first set of terminals of the receptacle to enable the connector module to transfer data with the receptacle according to a first standard when the connector module is inserted into the receptacle with the top plate contacting against the receptacle and the second detent stopping the sliding component at the fully retracted position relative to the housing.

12. The connector module of claim 11, wherein the first standard is a USB 2.0 standard.

13. The connector module of claim 10, wherein the first set of metal contacts electrically contacts with a first set of terminals of the receptacle and the resilient conductive component conducts the second set of metal contacts with the second set of terminals of the receptacle to enable the connector module to transfer data with the receptacle according to a second standard when the connector module is inserted into the receptacle with the top plate contacting against the receptacle and the first detent stopping the sliding component at the fully extended position relative to the housing.

14. The connector module of claim 13, wherein the second standard is a USB 3.0 standard.

15. The connector module of claim 8, further comprising a spring connected to the sliding component for automatically restoring the sliding component to an initial position as the sliding component disengages from the first detent or the second detent.

16. The connector module of claim 1, wherein the conductive resilient component comprises a V-shaped section and a reverse V-shaped section electrically connected to each other, and the V-shaped section of the conductive resilient component is for contacting the second set of metal contacts, and the reverse V-shaped section of the conductive resilient component is for being pressed by the receptacle.

* * * * *